United States Patent [19]

Okumura et al.

[11] Patent Number: 4,838,718

[45] Date of Patent: Jun. 13, 1989

[54] PRINTING DEVICE

[75] Inventors: Takashi Okumura; Koshiro Yamaguchi, both of Nagoya, Japan

[73] Assignee: Brother Kogyo Kabushiki Kaisha, Aichi, Japan

[21] Appl. No.: 947,915

[22] Filed: Dec. 29, 1986

[30] Foreign Application Priority Data

Jan. 8, 1986 [JP] Japan ..... 61-1535[U]
Jan. 8, 1986 [JP] Japan ..... 61-1536[U]

[51] Int. Cl.[4] ..... B41J 32/00

[52] U.S. Cl. ..... 400/234; 400/120; 400/208; 400/248

[58] Field of Search ..... 400/120, 234, 208, 248

[56] References Cited

U.S. PATENT DOCUMENTS 4,605,327 6/1986 Ueki et al. ..... 400/208
4,650,351 8/1987 Engle et al. ..... 400/120
4,657,418 4/1987 Lahr ..... 400/234 X
4,661,004 4/1987 Applegate et al. ..... 400/234
4,669,802 6/1987 Ukma et al. ..... 400/234 X

FOREIGN PATENT DOCUMENTS 2835002 2/1980 Fed. Rep. of Germany ..... 400/234
1139643 2/1985 U.S.S.R. ..... 400/234

*Primary Examiner*—Edgar S. Burr
*Assistant Examiner*—James R. McDaniel
*Attorney, Agent, or Firm*—Oliff & Berridge

[57] ABSTRACT

A printing device according to the present invention, the contact of a ribbon-guiding-member surface with the ribbon is increased, restraining the movement of the ribbon with the threading path bent by elastic restitution of the flexible ribbon guiding member. A printing device according to another features, accurate printing and correction is effected disregarding the play within the support arm or deformation of the carriage and limit a printhead to a predetermined printing line on a platen by restraining the movement of the nose end of a support arm with positioning members coupled thereto within proximity of the platen.

14 Claims, 10 Drawing Sheets

PRINTING DEVICE

BACKGROUND OF THE INVENTION

1. Field of the Invention

This invention relates to a printing device, more particularly, to a device with an ink ribbon enclosed within a case, which is so constructed that the ribbon is pulled out through an opening thereof to be fed outside and then, drawn into the inside chamber thereof through another opening. Moreover, this invention relates to a printing device for printing onto a printing sheet placed on a platen via a printhead mounted on a carriage especially when the carriage laterally moves on a guide member.

2. Prior Art

In the conventional printing device of the aforementioned type, ribbon guiding members such as rollers are attached along the threading path of a ribbon so that the ribbon is properly advanced.

Generally, upon printing by means of a conventional printing device, an outer running part of an ink ribbon is pressed against the platen by a printhead so as to type on a printing sheet placed on the platen. Therefore, with such device of the above type, the running part of the ink ribbon is kept tense during printing. However, after printing, when the printhead returns to its original position, the tension in the running part of the ink ribbon is released, resulting in a twist of the ink ribbon due to a shift thereof occurring on the ribbon guiding member such as a roller.

In another known type of the prior art, a support arm, with a printhead fixed to the nose end thereof, is attached to rotate a base end of a carriage. When not printing, the end of the support arm is positioned apart from a platen. When printing, on the other hand, the nose end of the support arm is rotated to a position adjacent to the platen, resulting in printing action via the printhead. However, using the printing device of the above type, when the nose end of the support arm is rotated to a position in the vicinity of the platen, the printhead fails to be accurately positioned to the predetermined printing line on the platen; this is due to such factors as play in the support arm attached to the carriage, or to the deformation of the carriage per se. Another problem has occurred that the printing device, including the correction mechanism, fails in the correction operation because the printhead is not accurately positioned for correcting o the printing sheet. The aforementioned troubles during printing or correcting by means of the conventional printing device have frequently occurred when the carriage employed in the device is formed from synthetic resins.

SUMMARY OF THE INVENTION

An object of the present invention is to provide a printing device in which the tension within the outer running part of an ink ribbon is released when a printhead returns to its original position after printing, so that the running part rarely shifts, preventing the ribbon from twisting.

Another object of the present invention is to provide a printing device in which the contact of a ribbon guiding member surfaces with the ribbon is increased, restraining the movement of the ribbon with the threading path bent by elastic resistance of a flexible guide member.

A further object of the invention is to provide a printing device in which the ribbon is reliably guided by the ribbon guiding member even when the printhead returns to its original position, thereby releasing the tension in the ribbon, and is smoothly advanced without being shifted even when the printhead is removed to a position adjacent to the platen after once it returned to its original position, thereby tensing the ribbon again.

Still a further object of the invention is to provide a printing device to effect accurate printing and correction disregarding the play within a support arm or deformation of a carriage.

An even further object of the invention is to provide a printing device to limit a printhead to a predetermined printing line on a platen by restraining the movement of the nose end of the support arm with positioning members coupled thereto within proximity of the platen.

The printing device according to the present invention includes: a plurality of ribbon guiding members, provided along the threading path of the ink ribbon, having circular outer peripheral surface and a portion for restraining the vertical motion of the ink ribbon, thereby guiding the ribbon to be run along the peripheral surface; and a flexible movement member including contact portions for contact with the ink ribbon to bend the threading path of the ribbon so that the range of contacted surface area around the respective ribbon guiding member is increased. The present invention employs a printing device in which the ribbon enclosed in a case is pulled out from an opening thereof to be fed, and then, drawn into the case through another opening thereof.

A printing device according to other features of the invention includes: a platen which extends laterally; a guide rod and a guide rail attached in parallel with the platen; a carriage movably attached onto the rod and the rail on which a printhead is mounted wherein when the carriage laterally moves on the guide rod and rail, the printhead prints on the printing sheet placed on the platen; a rotatable support arm attached to rotate on the carriage, to which is fixed the printhead at the nose end thereof, enabling the printhead to approach to or depart from a platen; and positioning members provided between the end of the support arm and the carriage so as to vertically position the end of the arm at the time when the end of the arm approaches the platen.

Upon using the printing device according to the invention, when the nose end of the support arm approaches the platen, the vertical shift thereof is regulated by engagement of the positioning members. The printhead, therefore, is accurately positioned without shift to correspond with a predetermined printing line on the platen. The device thus prints and corrects accurately independently of either any play in the support arm assembled to the carriage or deformation of the carriage per se.

BRIEF DESCRIPTION OF THE DRAWINGS

A more complete appreciation of the invention and many of the attendant advantages thereof will be readily obtained as the same becomes better understood with reference to the following detailed description as considered in connection with the accompanying drawings, wherein.

DETAILED DESCRIPTION OF THE PREFERRED EMBODIMENTS

Figure 1:
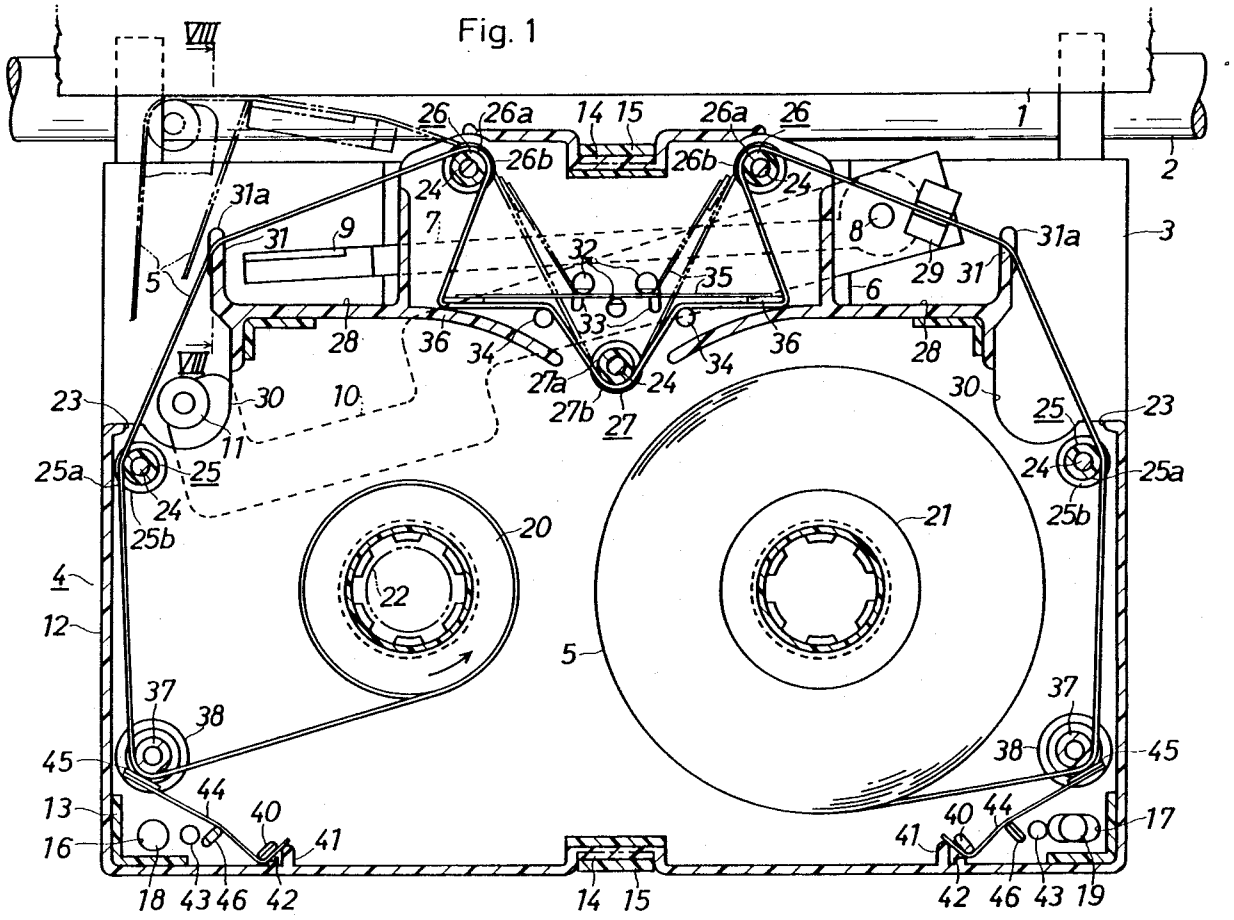
FIG. 1 is a partial-transverse-sectional view of a printing device employing an ink ribbon cassette embodied in accordance with the present invention.

Referring now to the drawings, and more particularly to FIG. 1 thereof, a printing device is shown which includes an ink ribbon cassette according to the first embodiment, and a laterally-extending platen 1 which is fixed at the rear side of a frame (not shown). A guide rod 2 is provided under the platen 1 in parallel therewith. A carriage 3 is attached to the rod 2 along the platen 1 in such a manner to be laterally movable. A cassette holder 6, which removably mounts the ink ribbon cassette 4 which encloses an ink ribbon 5, is attached on the upper surface of the carriage 3.

On the upper surface of the carriage 3, a support arm 7 is held to rotate at the base end by a shaft 8. A printhead 9 comprising a thermal head is fixed at the nose end of the support arm 7. The support arm 7 is activated by a spring (not shown) toward the direction in which the nose end of the arm 7 approaches toward the platen 1. When not printing, as shown in the solid line of FIG. 1, the support arm 7 is held away from the platen 1, against the spring force, by the action of a cam or the like. On the other hand, when printing, as shown in the dashed line of FIG. 1, the nose end of the support arm 7 is rotated into a printing position near the platen 1 by the action of the spring force in accordance with the rotation of the cam. Then, characters are printed by the printhead 9 on a printing sheet placed on the platen 1 through an outer running part of the ink ribbon 5. A rotational arm 10 is pivotally held at the base end thereof to the shaft 8 which is provided with the support arm 7. A pinch roller 11 composing a correction mechanism is attached to rotate at the nose end of the rotational arm 10. The arm 10 is activated by a spring (not shown) so that the nose end thereof approaches the platen 1. When the correction is not operational, as shown by the solid line of FIG. 1, the top surface of the rotational arm 10 is brought to a non-operational position away from the platen 1, against the spring force, by the action of the cam. During the correction operation, as shown by the dashed line of FIG. 1, the nose end of the arm 10 is driven along with the support arm 7 by the spring force toward the printing position near the platen 1 in accordance with the rotation of the cam. Then, the surface of the running part of the ribbon 5 contacts the printing sheet on the platen 1. With the above condition, the character printed on the sheet is corrected, being peeled off by means of the printhead 9 via the ribbon 5.

The ink ribbon 5 of the present embodiment, nonadhesive at normal temperature and melting at a predetermined elevated temperature is a thermal-transfer ribbon, with an ink layer, for creating an adhesive force at an intermediate temperature. Before the ribbon 5 heated by the printhead 9 is fed to reach the pinch roller 11, an adhesive force is produced at an intermediate temperature, which causes an ink character to be pulled off the printing sheet, adhered to the ink ribbon. More detailed description of the ink ribbon cassette 4 will be explained with reference to FIG. 1.

Except for negligible differences required for the assembly, the basic structure of the cassette 4 is symmetrical, including a case 12 of box type with its upper surface opened and a cover 13 attached thereto. Recesses 14 are formed in the respective center of both top and bottom edges of the case 12. An engaging pawl 15 mounted on a cassette holder 6 is removably engaged with the recesses 14, thereby the ink ribbon cassette 4 is held onto the cassette holder 6 with either obverse or reverse-side use of the ribbon 5. A circular, positioning hole 16 and an elliptical placing hole 17 are made in the bottom edges of the case 12 and the cover 13, respectively. The holes 16 and 17 are respectively engaged with conically-shaped stub axles 18 and 19 attached onto the cassette holder 6, so that the ink ribbon cassette 4 is placed onto the cassette holder 6. The holes 16 and 17 on the case 12 and the cover 13 are also formed in a diagonal position thereto, allowing positioning of the ink ribbon cassette 4 onto the holder 6 when reversed.

Figure 2:
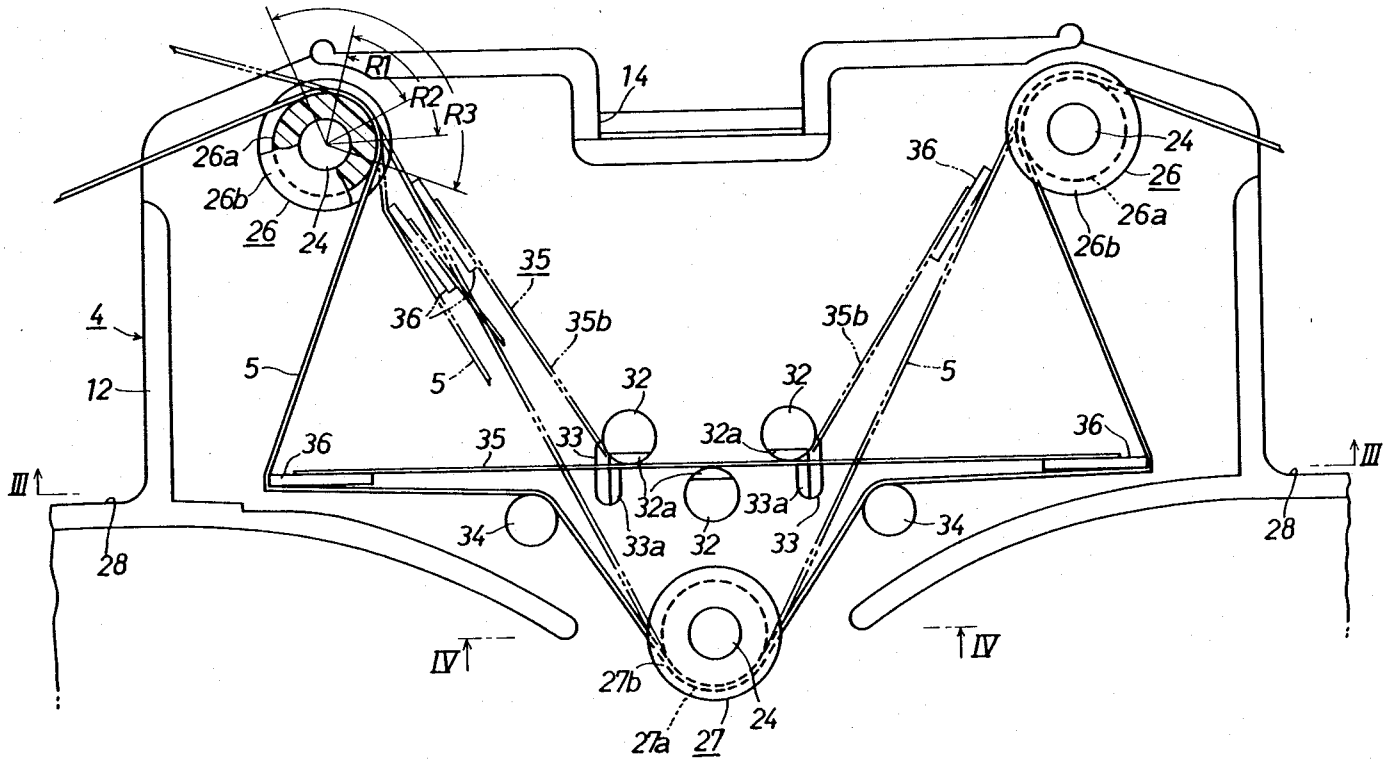
FIG. 2 is an enlarged plan view of an upper part of an ink ribbon cassette with its cover removed.
Figure 4:
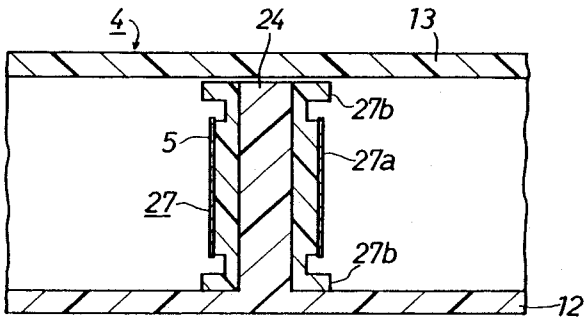
FIG. 4 is a partial-sectional view taken on line IV—IV of FIG. 2.

A pair of ribbon spools 20 and 21 are held to rotate within the case 12. With the cassette 4 held onto the cassette holder 6, the left ribbon spool 20 as a takeup spool functions in taking up the ink ribbon 5 by engaging with a takeup joint 22 on the carriage 3. The right ribbon spool 21, as a supply spool functions in supplying the ink ribbon 5. Openings 23 are bilaterally formed at opposite edges of the case 12. The length of the ribbon 5 supplied by the spool 21 is fed through the right opening 23 along, then, drawn into the case 12 through the left opening 23, and wound around the spool 20. As shown in FIGS. 1, 2 and 4, a plurality of pins 24 are placed at corresponding points of opposite sides of the case 12, near the edge of the top recess 14, and directly below the top recess 14, respectively. Rotational guide rollers 25, 26 and 27 are set upon the respective support pin 24, which serves to guide the threading path of the ink ribbon 5. As shown in FIG. 1, arc-shaped-outer-peripheral surfaces 25*a*, 26*a*, and 27*a* are provided around the center of the respective rollers 25, 26 and 27 to help feed the running part of the ribbon 5. A pair of flanges 25*b*, 26*b*, and 27*b* are fixed at both top and bottom ends of the respective rollers 25, 26 and 27 to restrain the vertical shift of the ribbon 5. A pair of receptive recesses 28 are bilaterally formed on the floor of the case 12 and are symmetrical to the roller 26. As shown in FIG. 1, with the ink ribbon cassette 4 set onto the cassette holder 6, the end of the support arm 7 is placed in its original position within the left recess 28. A ribbon end detector 29 made of a photo interrupter on the carriage 3 is placed in the right receptive recess 28. The recesses 28 are bisymmetrically provided to receive the nose end of the arm 7 so that the ink ribbon cassette 4 is usable even when reversed. The ribbon end detector 29 is placed to make effective use of the space, i.e., the right recess 28. A pair of arc-shaped recess bodies 30 are bilaterally formed on the floor of the case 12 at the respective sides of recesses 28. With the ink ribbon cassette 4 set on the cassette holder 6, the pinch roller 11 on the rotational arm 10 when in the non-operational position is placed within the left arc-shaped recess body 30.

Figure 8:
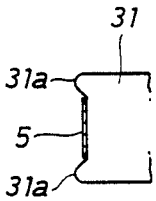
FIG. 8 is a partial-sectional view taken on line VIII—VIII of FIG. 1.

A pair of guide arms 31 are provided respectively on the floor of the case 12 between recesses 28 and the arc-shaped recess bodies 30. The left arm 31 prevents the ink ribbon 5 from contacting the nose end of the support arm 7 when in the original position and the pinch roller 11 in the non-operational position. The right arm 31 serves to guide the ink ribbon 5 toward the ribbon end detector 29. The operation and orientation of the respective arms 31 will be mutually exchanged in case the ink ribbon cassette 4 is reversed. As shown in FIGS. 1 and 8, a pair of restraining protrusions 31*a* are attached to the top and bottom of the respective arms 31, thereby the vertical shift of the ink ribbon 5 is restrained by a tapered surface.

Figure 3:
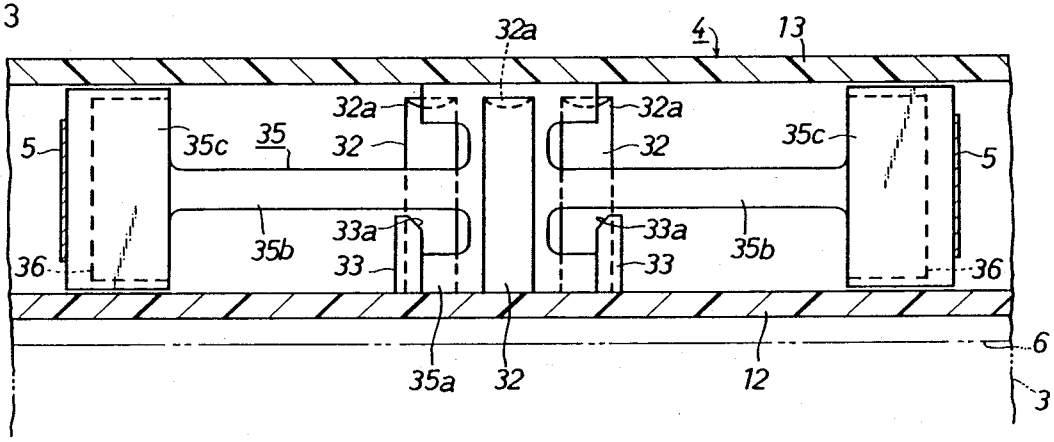
FIG. 3 is a partial-sectional view taken on line III—III of FIG. 2.

As shown in FIGS. 1 thru 3, three pins 32 are placed on the case 12 at predetermined intervals from one another at the upper side of the roller 27. Each of the pins 32 has an inclined surface 32*a* so as to face the others. A pair of short guide pins 33 are respectively provided on the floor of the case 12 adjacent both left and right pins 32. Each pin 33 has an inclined surface 33*a* at the top end thereof so as to face the other. A pair of guide pins 34 are provided on the floor of the case 12 at the sides of both left and right pins 33 thus guiding the ink ribbon 5 along the path around the rollers 26 and 27.

A flexible ribbon guiding member 35 attached onto the case 12 by means of the pins 32 and 33 is made from an elastic member such as a flat spring or the like. A base member 35*a* extending longitudinally, elastic arms 35*b* of small width, and support members 35*c* are each respectively provided at the center, both top and bottom, and both free ends of the body 35. Both top and bottom portions of the base member 35*a* are engaged with the pins 32, as shown in FIGS. 2 and 3, and are inserted between the pins 32 along with the inclined surfaces 32*a*, thereby restraining flection of the member 35. Opposite sides of the base member 35*a* are engaged with the pins 33 to restrain lateral shift of the member 35. The base member 35*a* is further fixed firmly between the case 12 and the cover 13, thereby preventing the support members 35*c* from being unstable, and resulting in stable and smooth supply of the ribbon 5. Contact members 36 with greater width than the ribbon 5 are fixed beneath the respective support members 35*c* of the flexible member 35 so as to be in contact with the facing surfaces of the case 12 and the cover 13.

Hereinafter, the operation of the member 35 will be described. As shown by the solid line of FIG. 1, with the printhead 9 in the original position and the pinch roller 11 released into the non-operational position, the member 35 is longitudinally elongated by its own elastic restitution. As shown by the solid line of FIG. 2, the contact members 36 bends the threading path to such an angle in order to produce the greatest amount of contact, R3, between the ribbon 5 and the arc-shaped outer surface 26*a* of the roller 26. Accordingly, since the vertical motion of the ribbon 5 is restrained by the flanges 26*b*, even when the tensile force applied to the ribbon 5 is weak, the rollers 26 surely and smoothly guide the ribbon 5 to be fed, resulted in no shear.

When printing, with the printhead 9 brought into printing position, as shown by the dashed line of FIG. 1, the ink ribbon is advanced. However, since a press member 44, which will be described later, prevents the ribbon 5 from being advanced in excess, the tension remaining in the ink ribbon 5 increases, thus bending the member 35 by the angle corresponding to the advanced length of the ribbon 5. Then, as shown by the dashed line of FIG. 2, the threading path of the ribbon 5 is slightly bent into contact with the surface 26*a* of the roller 26, with a medium amount of the contact, R2. In the above condition, when the ribbon 5 is advanced by the movement of the carriage 3 in accordance with the uptake of the ribbon 5 by the ribbon spool 20 in order to print, tension applied to the ribbon 5 increases to make the threading path more tense. Then, both elastic arms 35*b* of the member 35 are bent by great degrees shown by the dashed line of FIG. 2 in order to contact the ribbon 5 with the surface 26*a* of the roller 26 with the smallest amount of the contact R1. Sufficient tension is applied to the ribbon 5 despite the small area of contact R1, thereby avoiding the shift of the ribbon 5 from the roller 26. When the printhead 9 begins to return from the platen 1 to its original position with the supply of the ribbon 5 stopped, the tension applied to the ribbon 5 is reduced. Accordingly, the member 35 is restored to its initial straight position, thus drawing the ribbon 5 into the case 12 by bending the threading path of the excessively-supplied ribbon 5. Then, the ribbon 5 is brought into contact with the surface 26*a* of the roller 26 with the greatest area of the contact R3, thus increases the restraining range of the ribbon 5, resulting in reliable guiding.

The ink ribbon 5 apart from the left arm 31 is restored to position to be contacted therewith, however, since facing surfaces of the pair of restraining members 31*a* are tapered in shape, the ink ribbon 5 is adjusted to be properly supplied despite vertical movement thereof.

As shown by the dashed line of FIG. 1, during correction operation, with the printhead 9 placed in the printing position and the pinch roller 11 in the operating position, the amount of the supplied ribbon 5 is increased, in accordance with the movement of the pinch roller 11. The operation of the member 35 during correction is similar to that in printing except for the degree of flection of the elastic arms 35*b* which have been bent for the first time. Since the elastic arms 35*b* of the member 35 bend the threading path of the ribbon 5, restoring the nonoperational state even though the excessive amount of the ribbon 5 is supplied in accordance with the movement of the pinch roller 11, proper amount of the ribbon 5 can be taken up.

Upon using the printing device according to the present embodiment, the threading path is bent by restitution of the elastic arms 35*b*. of the flexible ribbon guiding member 35, in the case of either printing with the printhead 9 returned to the original position or correction with the pinch roller 11 restored to the non-operational position along with the release of tension remaining in the length of the ribbon 5. Accordingly, the ink ribbon 5 is brought into contact with the surfaces 26*a* of the rollers 26 with increased amount of area; i.e., the restraining range of the ribbon 5 is increased, thereby tensing the ribbon 5. Therefore, the ink ribbon 5 around the rollers 26 experiences little looseness or shifting, thereby preventing the formation of a twist therein. As shown in FIGS. 1, 5, 6, and 7, a pair of cylindrical members 37 are provided at both ends of the lower part of the case 12 in order to guide the ribbon 5 supplied from the ribbon spool 21 to the right cylindrical member 37, and in order to guide the ribbon 5 wound by the ribbon spool 20 towards the left cylindrical member 37. At the inner surface of the case 12 and the cover 13, annular restraining protrusions 38 and 39 are provided for preventing the ink ribbon 5 from vertically shifting.

Figure 5:
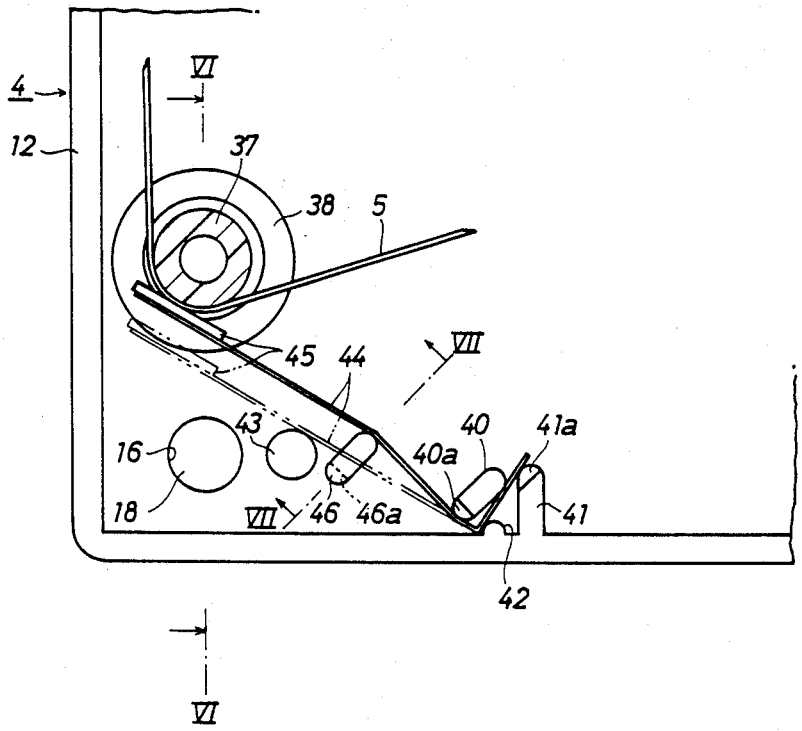
FIG. 5 is an enlarged plan view of a left fore-end part of the ink ribbon cassette with the cover removed.
Figure 6:
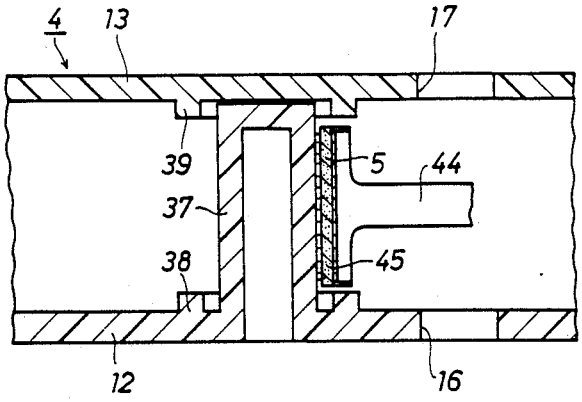
FIG. 6 is a partial-sectional view taken on line VI—VI of FIG. 5.

Three protrusions 40, 41 and 42, and a positioning pin 43 are provided adjacent both cylindrical guide members 37 on the floor of the case 12. As shown in FIG. 5, both protrusions 40 and 41 have inclined surfaces 40*a* and 41*a*, respectively. A press member 44, made of an elastic member such as a flat spring, is inserted between the protrusions 40 and 42, and also between the inclined surfaces 40*a* and 41*a* at the bent portion of the press member 44. A contact member 45, made of felt and in contact with the ink ribbon 5 fed by the cylindrical member 37, is fixed at the base end of the press member 44.

Figure 7:
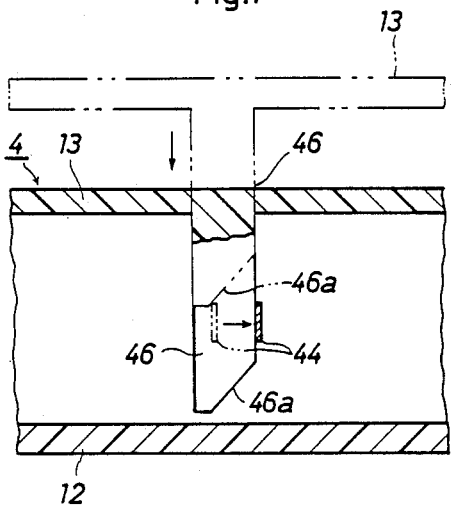
FIG. 7 is a partial-sectional view taken on line VII—VII of FIG. 5.

As shown in FIG. 7, an engaging protrusion 46, having an inclined surface 46*a* at its top end, is provided on the inner surface of the cover 13 corresponding to the position of the positioning pin 43. As shown by the dashed lines of FIGS. 5 and 7, with the bent portion of the press member 44 placed between protrusions 40 and 42 on the inner surfaces of the case 12 and with the cover 13, the inclined surface 46*a* of the engaging protrusion 46 is engaged with the press member 44 which is to be moved backward by the camming action of the inclined surface 46*a*. With the cover 13 attached to the case 12, as shown by the solid lines of FIGS. 5 and 7, the press member 44 is engaged with the rear edge of the engaging protrusion 46, so that the contact member 45 is in contact with the ink ribbon 5. Due to its elastic restitution, the press member 44 holds the ribbon 5 between the cylindrical member 37 and the contact member 45. As shown in FIG. 1, the right press member 44 functions in applying counter tension to the ink ribbon 5 which is pulled out. The left press member 44 functions in preventing the wound ribbon 5 from being unwound. Since both press members 44 are symmetrically oriented, in case the ink ribbon cassette 4 is inversely used, left and right press members 44 will mutually exchange the aforementioned respective function with one another.

A second embodiment according to the present invention is hereinafter described. As shown in FIGS. 9 thru 14, a platen 101, extending longitudinally, is mounted on a rear side of a frame (not shown). The guide means includes a guide rod 102 and a guide rail 103 of U-shaped cross section which extend along the platen 101 and are positioned, respectively, downward and forward thereof. The rail 103 is provided on the upper end thereof with a rack 104. A rear end portion of a carriage 105, made of synthetic resin, is movably mounted on the rod 102, and a fore end thereof is supported by the rod 102 and can slide along the lower end of the rod 102. A cassette 106 is mounted on the carriage 105 via a holder 107. The cassette 106 defines a interior chamber which may contain an outer running part of an ink ribbon which extends outwardly therefrom.

Figure 9:
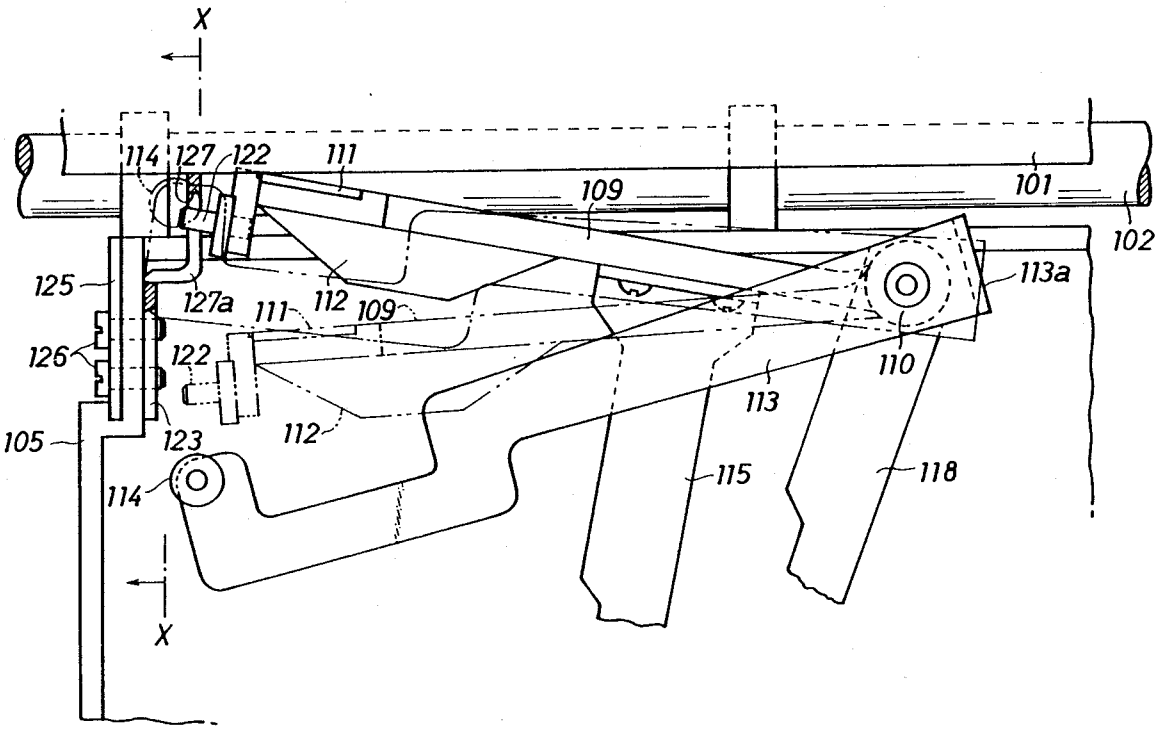
FIG. 9 is a partial-plan view of a printing device according to a second embodiment of the invention.
Figure 10:
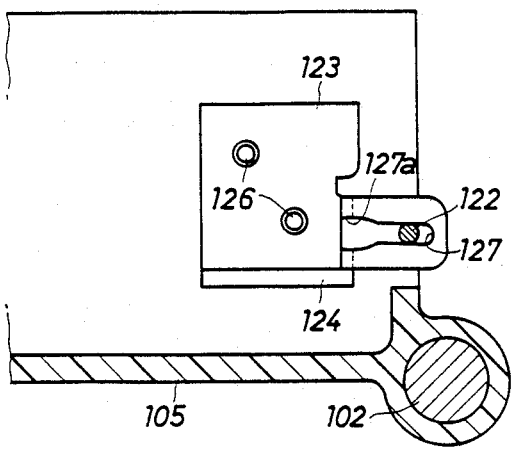
FIG. 10 is a partial-sectional view taken on line X—X of FIG. 9.
Figure 11:
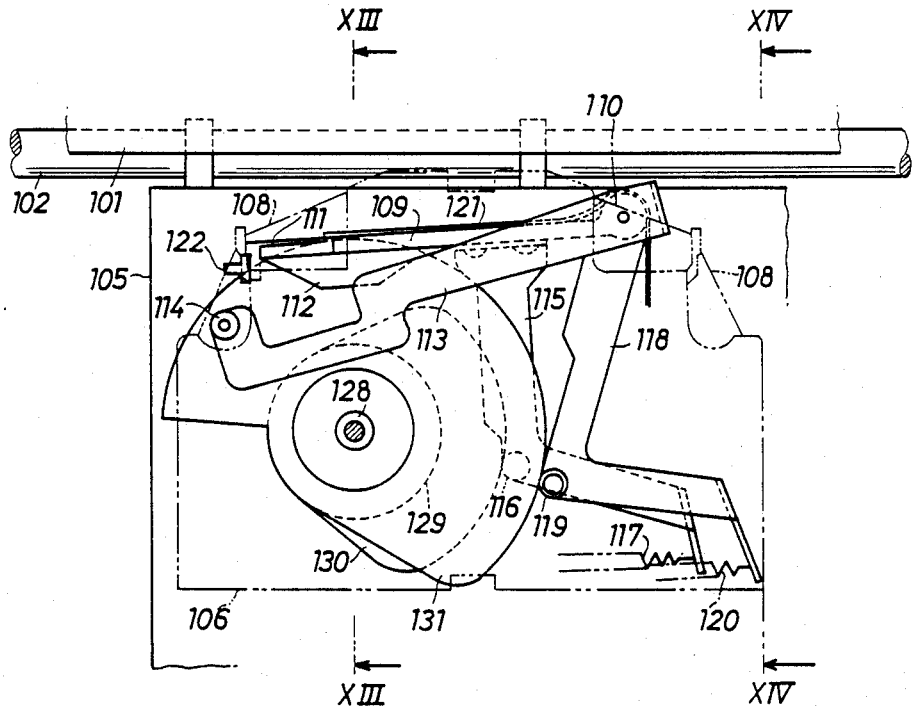
FIG. 11 is a partial-reduction plan view indicative of the construction of a working cam for operating the arms.
Figure 12:
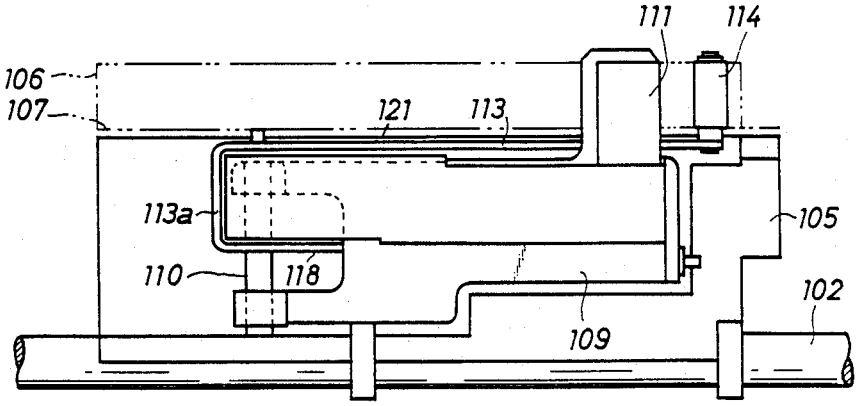
FIG. 12 is a partial-elevational view of FIG. 11.
Figure 16A:
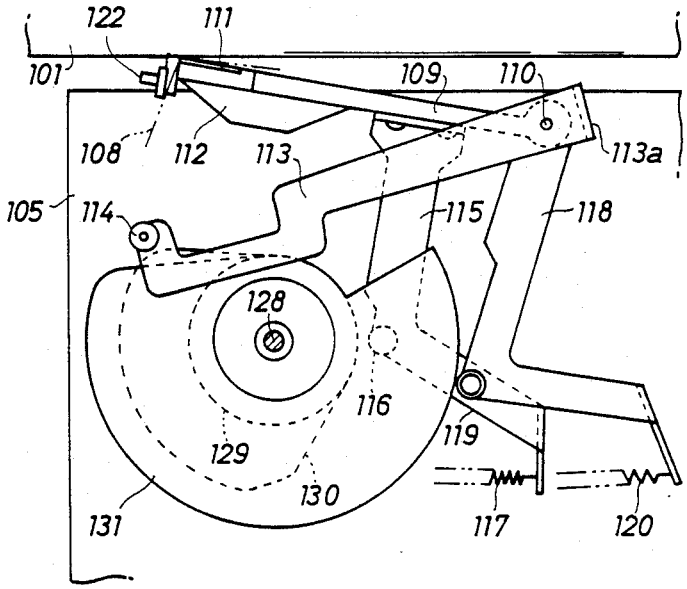
FIGS. 16A and 16B are partial-plan views illustrating the operation of printing and correction corresponding to FIG. 11.
Figure 16B:
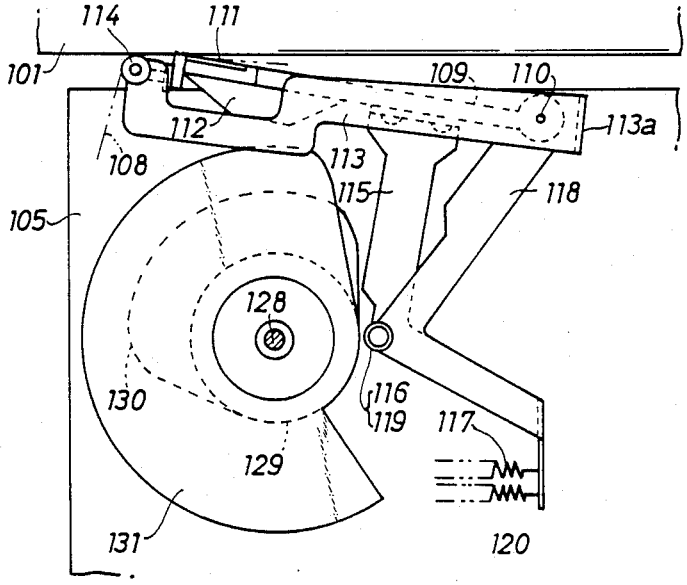

Referring to FIGS. 9, 11, and 12, an arm 109 pivots, on base end thereof, about an axle 110. The printhead including a thermal head is mounted onto a back surface of the nose end of the arm 109 and a cam 112 onto front surface thereof. As shown in FIG. 9, the axle 110 is brought into printing position close to the platen 101 (as shown by dashed line) and out of printing position away from the platen 101 (as shown by solid line). As shown in FIG. 16A, printing sheet upon the platen 101 is printed upon by a printhead 111, in printing position, pressing the ribbon 108 against the sheet. An arm pivots about the axle 110 at its U-shaped bent portion 113*a* thereof, which envelopes the base portion of the arm 109. A pinch roller 114 (for correction) is attached to the upper surface of the arm 113 and allowed to rotate. As shown in FIG. 9, the roller 114 is set in the active position close to the platen 101 as shown by dashed line, and set in the inactive position away from the platen 101 as shown by solid line in accordance with the rotation of the arm 113. As shown in FIG. 16B, when the roller 114 is brought into the active position and the head 111 is brought into the printing position, the running part of the ribbon 108 contacts the printing sheet on the head 111 and the ink portion of an erroneously typed letter is pulled bodily away from the printing sheet with it.

The ribbon 108 melts and is transferred onto printed character at a somewhat elevated temperature but is nontacky at room temperature, and adheres to the character at intermediate temperature therebetween. At first the ribbon 108 is heated to the predetermined elevated temperature. Next, during contact, the ribbon 108 with the printing sheet by the roller 114, the ribbon 108 cools down to the intermediate temperature and the character adheres to the ribbon 108. The ink portion is pulled away from the ink portion when the ribbon 108 is removed from the sheet at the position of the roller 114.

Figure 14:
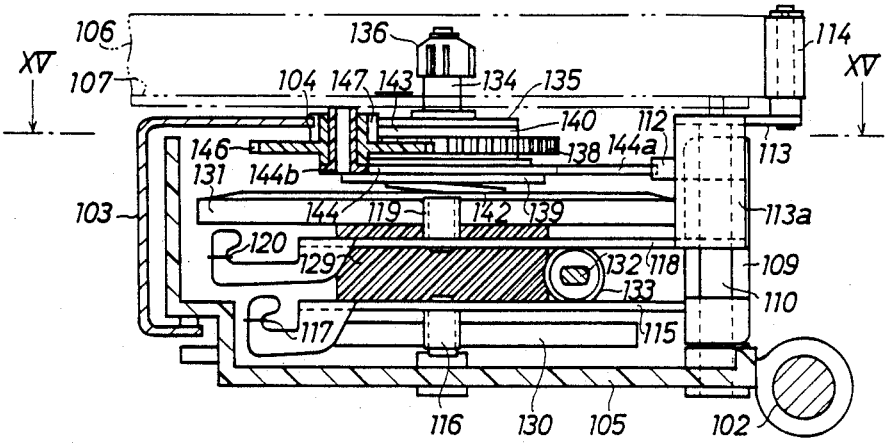
FIG. 14 is a partial-enlarged-sectional view taken on line XIV—XIV of FIG. 11.

Referring to FIGS. 11 and 14, an arm 115, the intermediate bent portion which supports a cam follower 116, is connected to the front surface of the arm 109. A spring 117, provided between an end portion of the arm 115 and the carriage 105 moves the arm 109 in a clockwise direction, as in FIG. 11, pushing the head 111 toward the printing position. Extending from lower, fore portion of a U-shaped portion of the arm 113 is an arm 118, the intermediate bent portion of which supports rotatable a cam follower 119. A spring 120, provided between an end portion of the arm 118 and the carriage 105, moves the arm 113 in a clockwise direction, as in FIG. 11, and activates the roller 114 into the operational position.

Referring to FIGS. 11 and 12, a flexible cable 121 connects with the head 111 and extends rightward along the rear side of the arm 109, wraps around the base portion of the arm 109, extends in the frontward and downward direction, connects with the circuit board (not shown) and the like, thus yielding small-sized the carriage 105. If the cable 121 extends directly downward from the head 111, it is necessary to provide an area in which the cable 121 is free to move over all pivoting range of the end portion of the arm 109.

Referring to FIGS. 9 thru 12, a pin 122, as positioning means, extends leftward from the lower end of the arm 109. A positioning plate 123 is mounted onto an attachment portion of the carriage 105 to the rod 102 such that the plate 123 is moved upward and downward via a protrusion 124. The plate 123 includes both a groove 127 as positioning means extending in a rear and forward direction therefrom, and an entrance 127*a* extending therefrom. When the axle 110 moves from a far position into printing position close to the platen 101 as shown by dashed line in FIG. 9, the pin 122 comes into engagement with the groove 127 of the plate 123, thereby restraining vertical movement. Since the position of the head 111 is determined in accordance with the rod 102, the plate 123 is set near the attachment portion of the carriage 105 with the rod 102 so that the head 111 is positioned accurately.

Figure 13:
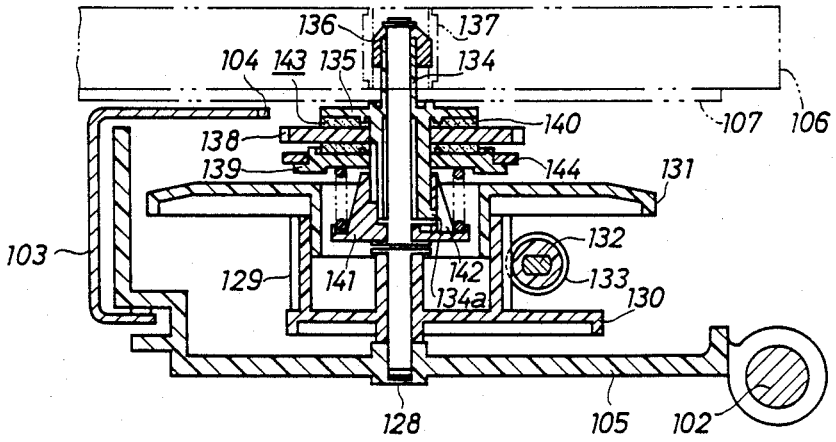
FIG. 13 is a partial-enlarged-sectional view taken on line XIII—XIII of FIG. 11.

Referring to FIGS. 11, 13, and 14 a shaft 128 extends upward from the carriage 105 in the forward direction from the arms 109 and 113. A cylindrical worm wheel 129 is supported to rotate on the shaft 128, and is provided with fan-shaped a working cam 130 around which the follower 116 is engaged on the arm 115 extending from the arm 109. To the upper end of the wheel 129 is attached a fan-shaped working cam 131 which has larger diameter than the cam 130 and around which the follower 119 is engaged on the arm 118 extending from the arm 113.

Figure 15:
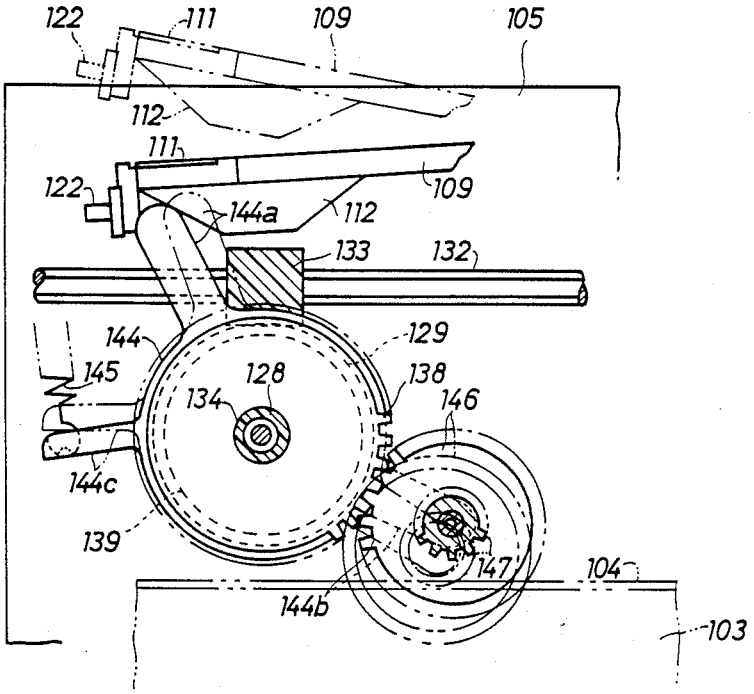
FIG. 15 is a partial-sectional view taken on line XV—XV of FIG. 14.

Referring to FIGS. 13 thru 15, in the rear direction of the wheel 129, the carriage 105 supports to rotate a driving shaft 132 which is of non-circular section and extends in the rightward and leftward direction and into which a worm 133, engaged with the wheel 129, is inserted to allow sliding movement. A rib (not shown) on the carriage 105 restrains the lateral movement(-rightward and leftward) of the worm 133 so that the worm 133 moves in position sense along the shaft 132 in accordance with the movement of the carriage 105. A motor (not shown) connects with the shaft 132 and drives the cams 130 and 131 via the shaft 132, the worm 133, and the wheel 129. When the followers 116 and 119 engage with the cams 130 and 131, respectively, the head 111 is kept in the non-operational position by the action of the spring 117 and the roller 114 is kept in non-operational position by the action of the spring 120. When the cams 130 and 131 are rotated clockwise direction to a predetermined angle, the follower 116 is disengaged from the cam 130, as shown in FIG. 16B, and only the head 111 is brought into the printing position. Conversely, when the cams 130 and 131 are rotated in a counter-clockwise direction to a predetermined angle, both the followers 116 and 119 are disengaged from the cams 130 and 131 respectively as shown in FIG. 16B and the head 111 is brought into the printing position and the roller 114 is brought into the operational(correcting) position.

Referring to FIGS. 13 thru 15, on the wheel 129, the shaft 128 is provided with a cylinder 134 to allow both rotation and vertical (upward and downward) movement of a cylinder 134 from which a clutch disk 135 extends. Attached to the upper end of the cylinder 134 is a takeup joint 136 which engages with a spool 137 within the cassette 106, and also rotates the spool 137 in the wound direction of the ribbon 108, in accordance with the rotation of the cylinder 134. Downward from the disk 135, a gear 138 and a disk 139 engages with an outer periphery of the cylinder 134 to allow both rotation, relative thereto, and vertical movement. At the upper surface of the disk 139 and the lower surface of the disk 135, a clutch 140 (made of felt and the like) is mounted to contact with the gear 138.

Downward from beneath the disk 139, a spring washer 140 engages with the outer peripheral surface of the cylinder 134 and they both to rotate. A spring 142 is interposed between the disk 139 and the washer 141, and one end thereof engages with the cylinder 134*a*. A clutch 143 includes the disk 135, the disk 139, the clutch 140 and so on. Power is transmitted from the gear 138 to the cylinder 134 via the clutch 143. When the speed of 138 is greater than that of 134, the clutch 143 is disengaged.

Referring to FIGS. 13 thru 15, a disk 144 is mounted on the outer peripheral surface of the disk 139 while allowing free rotation relative thereto. Extending from the outer peripheral surface of the disk 139 are a protrusion 144*a* (which engages with a cam 112 on the arm 109), a protrusion 144*b*, and an engaging piece 144*c*. A spring 145 interconnects the piece 144*c* of the disk 144 and the carriage 105, thereby moving the disk 144 in the clockwise direction as in FIG. 15. A gear 146 is supported to rotate on the protrusion 144*b* of the disk 144, and is engaged with the gear 138. A pinion 147 is provided at the upper surface of the gear 146 to engage with the rack 104 on the rail 103.

As shown in FIG. 15, when the head 111 is set in the non-operational position, the protrusion 144*a* engages with the cam 112 on the arm 109, and the disk 144 is set into the position as shown by the solid line, thereby disengaging the pinion 147 from the rack 104. Conversely, when the head 111 is set into non-operational position as shown by dashed line, the protrusion 144*a* disengages from the cam 112 on the arm 109, and the disk 144 is moved by the action of the spring 145 in a clockwise direction, thereby engaging the pinion 147 with the rack 104.

FIG. 16A shows the printing position and FIG. 16B shows the correcting position. Upon rightward movement of the carriage 105 by motor (not shown), the pinion 147 is rotated toward clockwise as shown in FIG. 15 via an engagement between the pinion 147 and the rack 104, thereby transmitting the rotation of the pinion 147 to the joint 136 via the gear 146, the gear 138, the clutch 143, and the cylinder 134. The spool 137 is thus rotated in the wound direction of the ribbon 108. The speed of the ribbon 108 increases in accordance with an increase in the wound diameter, despite that the spool 137 rotates with constant speed responsive to the movement of the carriage 105. The clutch 143, in the guide path, is caused to slide. As shown in FIGS. 16A and 16B, the ribbon 108 is moved in a relative left direction in accordance with the rightward movement of the carriage 105 with the same speed, then sliding into the printing position where the head 111 contacts the printing sheet. The printing device according to the present embodiment, during printing as shown in FIG. 16A and during correction as shown in FIG. 16B, the pin 122 of the arm 109 engages with the groove 127 of the plate 123 on the carriage 105, thereby restraining the vertical direction of the head 111. Therefore, the head 111 is positioned accurately as corresponding to a predetermined printing line so that accurate printing and correction is performed despite neither play between the arm 109 and the carriage 105 nor deformation of the carriage 105.

While the invention has been described with reference to a preferred embodiment thereof, it is to be understood that variations or the modifications may be easily made by anybody of ordinary skill in the art without departing from the spirit and scope of this invention as defined by the appended claims.

What is claimed is:

1. A printing device comprising a chamber, a supply of ribbon contained within said chamber, an opening for exit and entrance of said ribbon from and into said chamber;

a ribbon guiding means provided along a threading path on which said ribbon advances, for guiding said ribbon and for restraining lateral movement of said ribbon; and a resiliently deformable, integrally constructed, elastic movement means for changing said threading path to change the tension on said ribbon, said movement means comprising a base member connected to a case, a contacting member which contacts said ribbon and a flexible member extending from said base member, said flexible member comprising a pair of elastic arms extending symmetrically from said base member, each having a support member extending therefrom, said movement means selectively conforming to a first form and a second form, said movement means in said first form causing a decrease in a contact area established between said ribbon and said ribbon guiding means, and said movement means in said second form causing an increase in said contact area.

2. A printing device according to claim 1 wherein said ribbon guiding means includes a roller having an outer peripheral surface and a pair of a flanges extending therefrom for guiding said ribbon around said outer peripheral surface.

3. A printing device according to claim 1 wherein said flexible member includes a pair of elastic arm of small width extending symmetrically from said base member, each having a support member extending therefrom and said movement means further comprises a contacting member which contacts said ribbon.

4. A printing device according to claim 3 wherein said case is symmetrical and reversible.

5. A printing device according to claim 3 wherein opposite sides of said base member are engaged with said hold member to restrain lateral shift of said movement means, said base member being fixed between a case and a cover, preventing said flexible member from being unstable, thereby providing stable and smooth supply of said ribbon.

6. A printing device according to claim 5 wherein said contacting member has a greater width than said ribbon and is fixed on one side of said support member of said movement means and said movement means deforms into said first and second forms in a space defined between said case and cover.

7. A printing device according to claim 1 wherein top and bottom portions of said base member are engaged with hold members provided in said case, and are inserted between said hold members along inclined surfaces on the hold members, thereby restraining flection of said movement means.

8. A printing device according to claim 1 wherein opposite sides of said base member are engaged with said hold member to restrain lateral shift of said movement means, said base member being fixed between a case and a cover, preventing said flexible member from being unstable, whereby providing stable and smooth supply of said ribbon.

9. A printing device including a chamber having a supply of ribbon contained therein between a supply drum and a take-up drum, said device comprising:

an outlet and inlet in said chamber defining an exit and an entrance of said ribbon from and into said chamber;

a ribbon guiding means adjacent said inlet and outlet, a thread path being defined from said supply drum and across said ribbon guiding means to said take-up drum;

a resilient planar member located along said thread path between said ribbon guiding means for extending and shortening said thread path in response to tension in said ribbon, said resilient planar member comprising a base member connected to a case, a contacting member which contacts said ribbon and a flexible member extending from said base member, said flexible member comprising a pair of elastic arms extending symmetrically from said base member, each having a support member extending therefrom, said movement means comprising an integrally constructed elastic member selectively conforming to a first position for extending said thread path to increase a contact area between said ribbon and said ribbon guiding means, and a second position for shortening said thread path to decrease the contact area.

10. The printing device of claim 9 wherein said resilient planar member in the first position extends the thread path in response to a decrease in tension in said ribbon, and said resilient planar member in the second position shortens the thread path in response to an increase in tension.

11. The printing device of claim 9 wherein said resilient planar member defines a plate shape in said first position, and a V-shape in said second position.

12. The printing device of claim 9 wherein said resilient planar member includes a fixed pivot section and two arm sections extending therefrom and contacting said ribbon.

13. The printing device of claim 12 wherein said arm sections move toward said ribbon guiding means in the second position.

14. A printing device comprising a chamber, a supply of ribbon contained within said chamber, an opening for exit and entrance of said ribbon from and into said chamber;

a ribbon guiding means for guiding said ribbon and restraining lateral movement of said ribbon;

a printhead reciprocating between a printing position and a non-printing position wherein said printhead in said printing position contacts said ribbon and said printhead in said non-printing position separates from said ribbon; and movement means for resiliently changing tension of said ribbon, said movement means comprising a base member connected to a case, a contacting member which contacts said ribbon and a flexible member extending form said base member, said flexible member comprising a pair of elastic arms extending symmetrically from said base member, each having a support member extending therefrom, said movement means comprising an integrally constructed elastic member capable of bending into a first form when said printhead is in said printing position, and into a second form when said printhead is in said non-printing position, the bending of said movement means causing a decrease in a contact area established between said ribbon and said ribbon guiding means in said first form, and causing an increase in said contact area in said second form.

* * * * *